US010484779B2

(12) United States Patent
Ansari

(10) Patent No.: US 10,484,779 B2
(45) Date of Patent: Nov. 19, 2019

(54) APPARATUS FOR CONTROLLING HEADPHONES

(71) Applicant: Harman International Industries, Incorporated, Stamford, CT (US)

(72) Inventor: Imran Anis Ansari, Shenzhen (CN)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/112,967

(22) Filed: Aug. 27, 2018

(65) Prior Publication Data

US 2019/0069072 A1 Feb. 28, 2019

Related U.S. Application Data

(60) Provisional application No. 62/550,941, filed on Aug. 28, 2017.

(51) Int. Cl.
*H04R 1/10* (2006.01)

(52) U.S. Cl.
CPC ..... *H04R 1/1041* (2013.01); *H04R 1/105* (2013.01); *H04R 1/1016* (2013.01); *H04R 1/1033* (2013.01); *H04R 1/1075* (2013.01); *H04R 2460/03* (2013.01)

(58) Field of Classification Search
USPC ..... 381/74, 115, 117, 367, 370, 376, 384
See application file for complete search history.

(56) References Cited

U.S. PATENT DOCUMENTS

| | | | | |
|---|---|---|---|---|
| 9,167,329 | B2 | 10/2015 | Honeycutt | |
| 2009/0268936 | A1 | 10/2009 | Goldberg et al. | |
| 2010/0166207 | A1* | 7/2010 | Masuyama | H04R 1/1041 381/74 |
| 2013/0129110 | A1* | 5/2013 | Harper | H04R 1/1041 381/74 |
| 2017/0111489 | A1* | 4/2017 | Seo | G06F 3/165 |

FOREIGN PATENT DOCUMENTS

| | | | |
|---|---|---|---|
| CN | 204993760 | U | 1/2016 |
| CN | 205864666 | U | 1/2017 |
| KR | 101144271 | B1 | 5/2012 |
| WO | 2013075098 | A1 | 5/2013 |

* cited by examiner

*Primary Examiner* — Yosef K Laekemariam
(74) *Attorney, Agent, or Firm* — Brooks Kushman P.C.

(57) ABSTRACT

In at least one embodiment, a headphone system is provided. The system includes a first housing, a second housing, a flexible coated wire, a first loudspeaker, a second loudspeaker, and a magnet. The flexible coated wire is coupled to the first housing and the second housing. The first loudspeaker is positioned within the first housing for transmitting an audio signal. The second loudspeaker is positioned within the second housing for transmitting the audio signal. The magnet is embedded within the flexible coated wire for electrical coupling with a sensor positioned within the first housing to control an operation of playback of the audio signal based on a distance of the magnet in relation to the first housing.

20 Claims, 3 Drawing Sheets

APPARATUS FOR CONTROLLING HEADPHONES

CROSS-REFERENCE TO RELATED APPLICATIONS

This application claims the benefit of U.S. provisional Application No. 62/550,941 filed on Aug. 28, 2017, the disclosure of which is hereby incorporated by reference in its entirety herein.

TECHNICAL FIELD

Aspects disclosed herein generally relate to an apparatus for controlling headphones. These aspects and others will be discussed in more detail herein.

BACKGROUND

U.S. Pat. No. 9,167,329 to Honeycutt discloses an earphones holder that is used to affix a headset to clothing and/or other items. The earphones holder comprises a magnet which removably couples with a magnetically attractable portion of a set of earphones. In some embodiments, the earphones holder further comprises an electronic device controller which controls the operation of an electronic device. The controller is configured to send a signal to an electronic device activation circuit which operates the electronic device based upon a coupling status of the earbuds with the one or more magnetically attractable surfaces of the earphones holder body. In some embodiments, the electronic device controller controls the operation of an electronic device. The controller is configured to send a signal to an electronic device activation circuit which operates the electronic in a manner dependent upon a signal from the holder body.

SUMMARY

In at least one embodiment, a headphone system is provided. The system includes a first housing, a second housing, a flexible coated wire, a first loudspeaker, a second loudspeaker, and a magnet. The flexible coated wire is coupled to the first housing and the second housing. The first loudspeaker is positioned within the first housing for transmitting an audio signal. The second loudspeaker is positioned within the second housing for transmitting the audio signal. The magnet is embedded within the flexible coated wire for electrical coupling with a sensor positioned within the first housing to control an operation of playback of the audio signal based on a distance of the magnet in relation to the first housing.

In at least another embodiment, a headphone system including a first housing, a second housing, a flexible coated wire, a first loudspeaker, a second loudspeaker, and a magnet is provided. The flexible coated wire is coupled to the first housing and the second housing. The first loudspeaker is positioned within the first housing for transmitting an audio signal. The second loudspeaker is positioned within the second housing for transmitting the audio signal. The magnet is electrically coupled with a sensor positioned within the first housing to control playback of the audio signal. The flexible coated wire includes an ear hook having the first housing positioned on one end of the ear hook and the magnet positioned on another end of the ear hook to position the magnet adjacent to the sensor in the first housing.

In at least another embodiment, a headphone assembly including a first housing, a second housing, a flexible coated wire, a first loudspeaker, a second loudspeaker, and a magnet is provided. The flexible coated wire is coupled to the first housing and the second housing. The first loudspeaker is positioned within the first housing for transmitting an audio signal. The second loudspeaker is positioned within the second housing for transmitting the audio signal. The magnet is embedded within the flexible coated wire for electrical coupling with a sensor positioned within the first housing to control an operation of the headphone assembly based on a distance of the magnet in relation to the first housing.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The embodiments of the present disclosure generally provide for a plurality of circuits or other electrical devices. All references to the circuits and other electrical devices and the functionality provided by each are not intended to be limited to encompassing only what is illustrated and described herein. While particular labels may be assigned to the various circuits or other electrical devices disclosed, such labels are not intended to limit the scope of operation for the circuits and the other electrical devices. Such circuits and other electrical devices may be combined with each other and/or separated in any manner based on the particular type of electrical implementation that is desired. It is recognized that any circuit or other electrical device disclosed herein may include any number of microcontrollers, graphics processor unit (GPU), integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electrical devices may be configured to execute a computer-program that is embodied in a non-transitory computer readable medium that is programmed to perform any number of the functions as disclosed.

Figure 1:
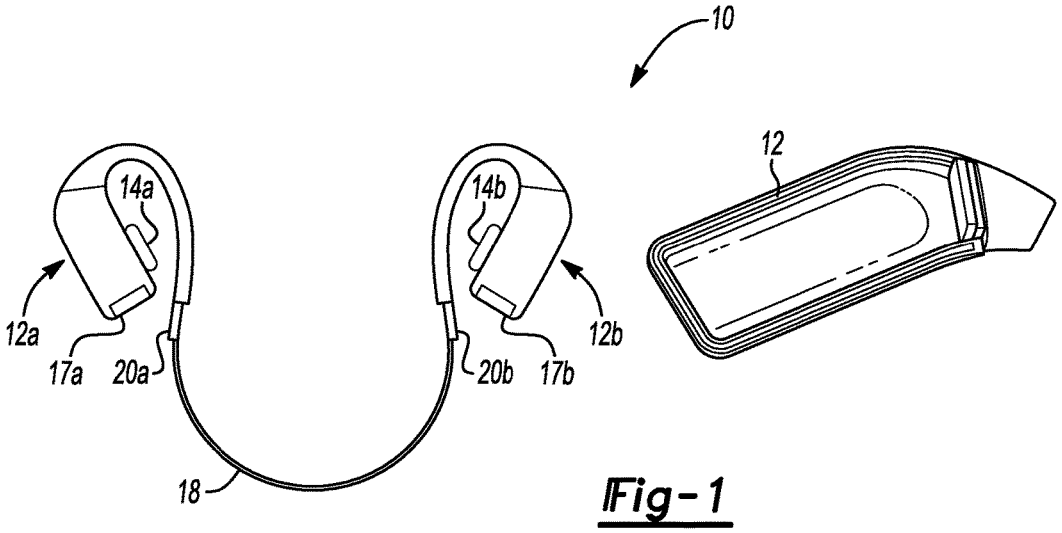
FIG. 1 depicts headphones in accordance to one embodiment.

FIG. 1 depicts headphones 10 in accordance to one embodiment. The headphones 10 generally include a plurality of a housings 12*a*-12*b* (or 12) that each include a corresponding loudspeaker 14*a*-14*b* (or 14) respectively attached thereto to provide audio playback for a user. Each housing 12*a* and 12*b* includes electronics (not shown) to enable audio playback. A mobile device (not shown) may transmit audio data to the headphones 10 to playback audio data for the user. In another example, the headphones 10 may include memory (not shown) positioned in at least one of the housings 12 to store the audio data and to playback the same for the user as opposed to the mobile device providing the audio data for the headphones 10. It is recognized that the headphones 10 may not be used exclusively for audio playback. For example, the headphones 10 may also include a microphone (not shown) to receive an audio input from the user. The headphones 10 may in turn transmit the audio input to a mobile device or other suitable device in the event the headphones 10 are used in connection with the mobile device for mobile communication with another party.

A flexible coated wire 16 (see FIG. 2) is attached to each end of the housing 12. The coated wire 16 generally includes electrical wiring 18 to facilitate electrical communication between the electronics positioned within each housing 12*a* and 12*b*. A plurality of magnets 20*a* and 20*b* are positioned about the coated wire 16 and the electrical wiring 18. Each housing 12*a* and 12*b* includes a corresponding hall effect sensor 17*a* and 17*b* (or "17") that detects magnetic flux from a corresponding magnet 20*a* and 20*b*, respectively.

In general, when the hall effect sensor 17 is positioned within a predetermined operation distance from a corresponding magnet 20*a* or 20*b* ("20"), the headphones 10 may continue to playback audio data for the user and the current operating state of the headphones 10 remains unchanged. If, however, the user moves the housing 12 away from the user's ear to a distance that is greater than the predetermined operating distance from the magnet 20 such that the hall effect sensor 17 detects a change in the magnetic flux from the magnet 20, the current operational state of the headphones 10 may then change. In one example, the predetermined operating distance may correspond to a length (or distance) of 2 mm to 20 mm. It is recognized that the predetermined operating distance may vary based on the size and shape of the ear of the user.

For example, the user may intend for the headphones 10 to pause or stop the playback of audio data. To achieve this desired operation, the user may simply move at least one of the housings 12 away from any one of the magnets 20 for the headphones 10 to pause or stop the playback of the audio data. In this case, it is not necessary for the user to completely remove the headphones 10 from the user's head as the headphones 10 can continue to be placed on the user's head. For example, a single housing 12 can be moved outside of the predetermined operating distance from the magnet 20 to stop or pause the playback of the audio data. This condition may be easier than physically toggling a switch that is present on the headphones 10 as this may be tedious for the user. When it is time for the user to resume playback of the audio data, the user may simply move the housing 12 (i.e., and the hall effect sensor 17 positioned therein) to a distance that is within the predetermined operating distance of the magnet 20. Once the hall effect sensor 17 detects the appropriate level of the magnetic flux from the corresponding magnet 20, the headphones 10 will resume audio playback for the user. It is recognized that any number of operational states for the headphones 10 may be controlled by moving the housing 12 to and from the magnet 20 such as power on/power off, activate/deactivate phone call, active/standby, etc.

For example, in the event the headphones 10 are intended for a user who utilizes the headphones 10 for sporting activities (e.g., running, etc.), the operational state that may be controlled via the hall effect sensor 17 and the magnet 20 implementation may be a power on/off feature for quick readiness. In the event the headphones 10 are intended for a user who utilizes the headphone 10 for conference call applications, the operational state that may be controlled via the hall effect sensor 17 and the magnet 20 implementation may correspond to a call answer and call hang up feature. In the event the headphones 10 are intended for a user to simply listen to audio for entertainment purposes (i.e., music listening), the operational state that may be controlled via the hall effect sensor 17 and the magnet 20 implementation may correspond to a playback and pause feature. It is recognized that a mobile device (or other suitable device such as a laptop, tablet, etc.) may include hardware that executes instructions to provide a user interface to enable a user to select various operational states that are controlled on the headphones 10 based on the end item use of the headphones 10.

Figure 2:
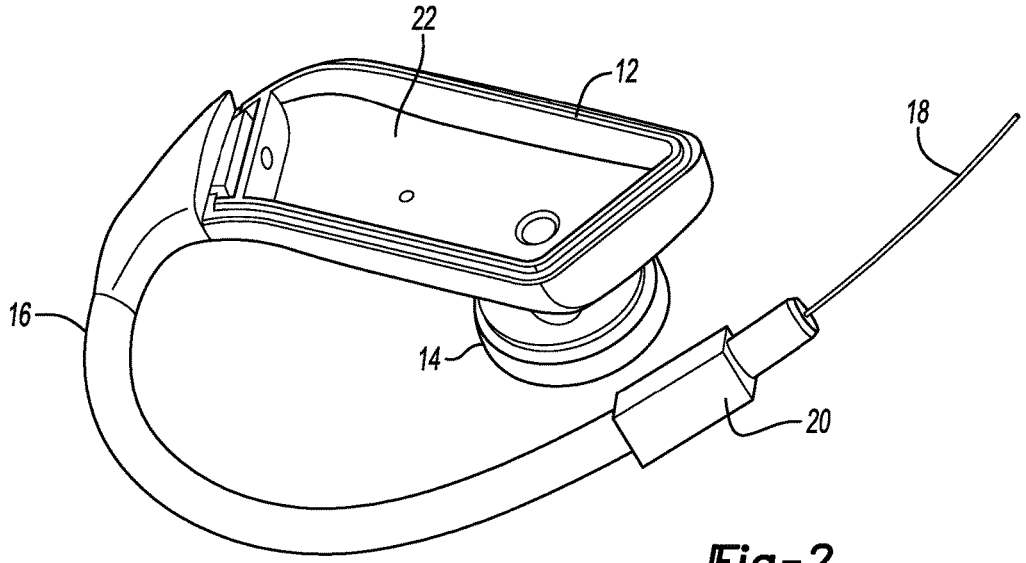
FIG. 2 depicts one aspect of the headphones in accordance to one embodiment.

FIG. 2 depicts one aspect of the headphones 10 in accordance to one embodiment. As shown, each housing 12 generally includes a cavity 22 for receiving the electronics (not shown). The flexible coated wire 16 enables the housing 12 to move to and from the user's ear as desired by user. As also shown, each loudspeaker 14 is attached to the corresponding housing 12 and protrudes from the housing for insertion into a user's ear.

Figure 3:
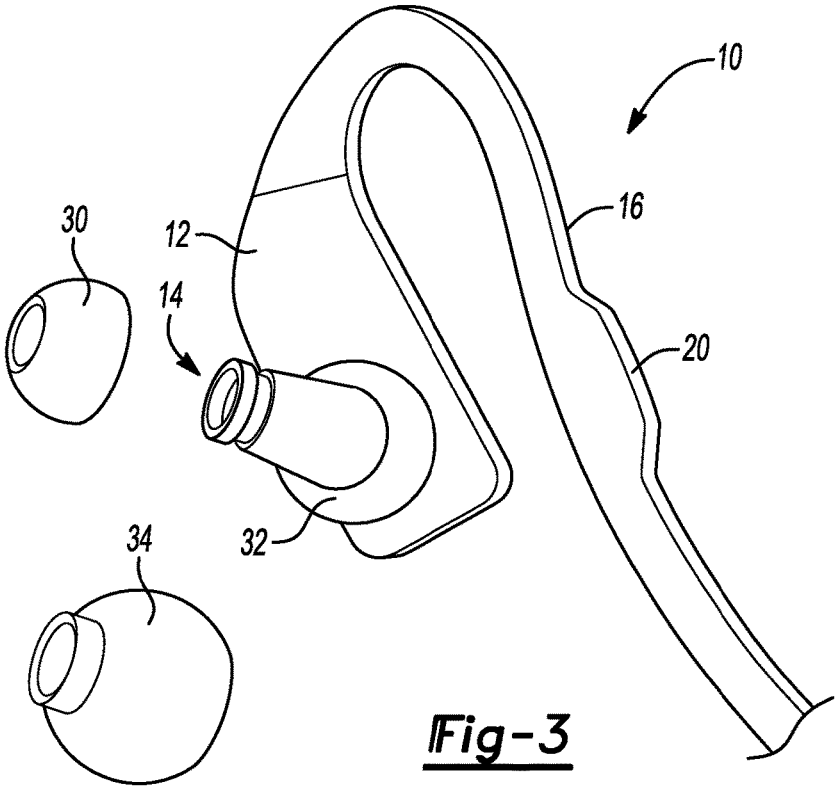
FIG. 3 depicts another aspect of the headphones in accordance to one embodiment.

FIG. 3 depicts another aspect of the headphones 10 in accordance to one embodiment. The headphones 10 may include any one of an ear mount tip 30, ear tip 32, and a concha ear tip 34 for insertion over the loudspeaker 14 to provide additional comfort for the user when the loudspeaker 14 is inserted into the user's ear. Each magnet 20 may be embedded (or over-molded) within the flexible coated wire 16. As show, the magnet 20 is completely embedded or completely covered by the flexible coated wire 16 and physically separated from the housing 12. The magnet 20 may be positioned adjacent to the electrical wiring 18 within the flexible coated wire 16. The magnet 20 may be overmolded in a tool which applies a thermoplastic elastomer (TPE) based material over both the electrical wire 18 and the magnet 20.

Figure 4:
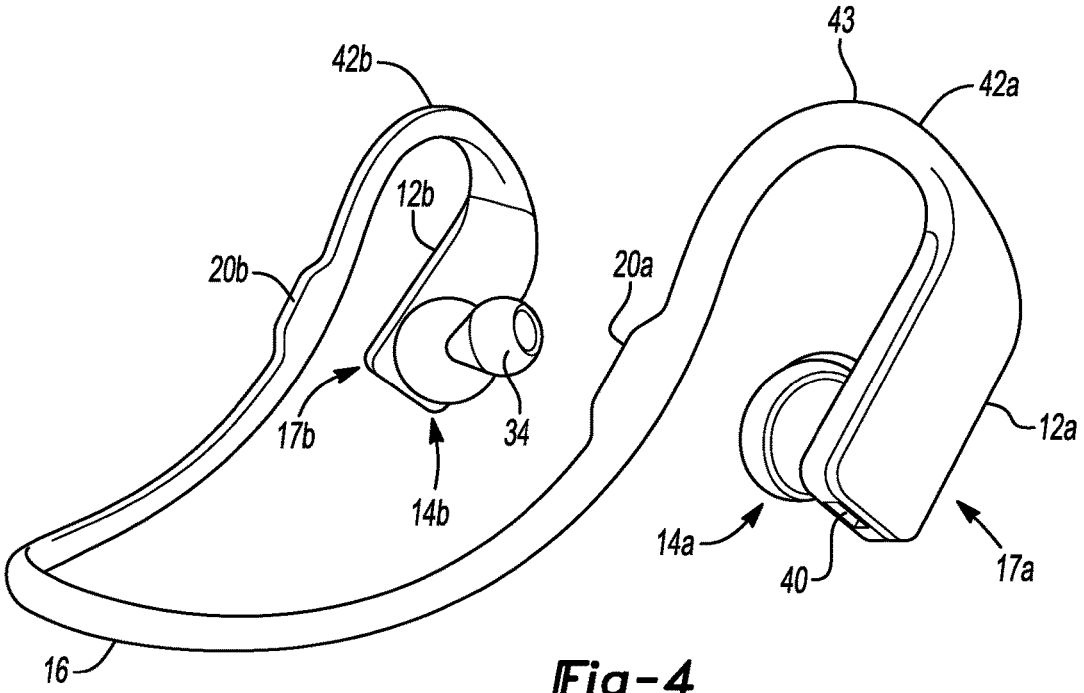
FIG. 4 depicts another aspect of the headphones in accordance to one embodiment.

FIG. 4 depicts a full implementation of the headphones 10 including the magnet 20*a*, 20*b* being embedded in the flexible coated wire 16. The housing 12 generally includes an interface port 40 (e.g., USB port) for receiving a memory stick (or flash driver, etc.) that may alternatively provide audio data for playback. The interface port 40 may also receive an external connector to provide power from an external power supply to charge the headphones 10. In addition, a portion of the flexible coated wire 16 forms an ear hook 42*a* and 42*b* on each side of the headphones 10. Each ear hook 42*a* and 42*b* may be wrapped around a corresponding ear to keep the position of the magnet 20*a*, 20*b* stable or fixed while the user moves the housing 12*a*, 12*b* to and from the magnets 20*a* and 20*b* to select the desired headphone operation. As shown, the ear hooks 42*a*, 42*b* each include a looped portion 43*a*, 43*b* (or "43") that extend above the magnets 20*a*, 20*b*, respectively (see also FIG. 3). As further shown, the looped portion 43 is positioned between the loudspeaker 14 of a corresponding housing 12 and the magnet 20. Specifically, and as further shown in FIG. 4, the looped portion 43 forms curve in which the housing 12 is positioned on one side of the curve (or looped portion 43) and the magnet is positioned on opposite side of the curve. FIG. 4 further illustrates that the looped portion 43 positions the magnet 20 adjacent to the sensor 17 in the housing 12.

Figure 5:
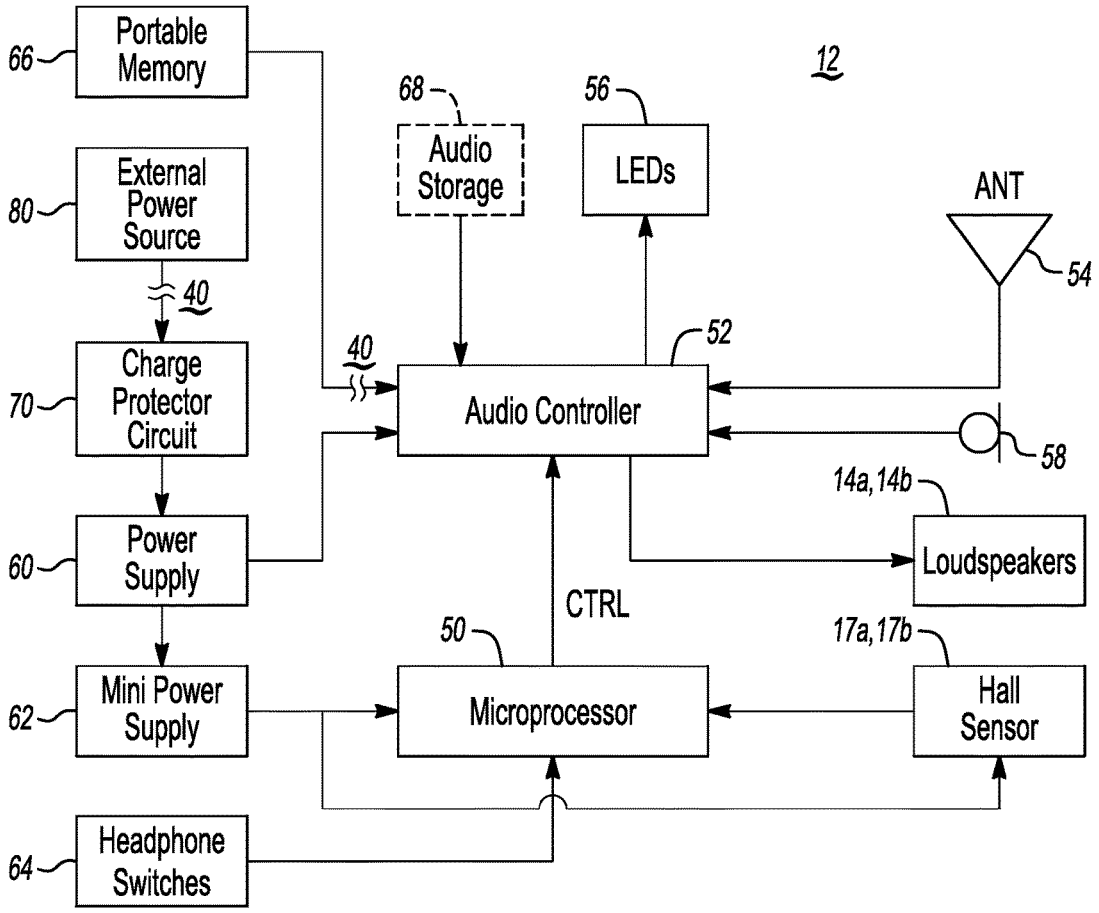
FIG. 5 depicts a more detailed implementation of the headphones in accordance to one embodiment.

FIG. 5 depicts a more detailed implementation of the headphones 10 in accordance to one embodiment. The headphones 10 include a microprocessor 50, an audio controller 52, an antenna 54, one or more light emitting diodes (LEDs) 56, a microphone 58, a first power supply 60, a second power supply 62, and a plurality of switches 64. Portable memory 66 may be received at the interface port 40 to provide limited amounts of audio data for audio playback. The portable memory 66 may be a USB flash drive, SD card, or other suitable memory apparatus. Each of the foregoing components may be positioned within the housing 12*a* and/or housing 12*b*. It is recognized that the hall effect sensor 17 may be positioned in a single housing 12*a* or 12*b*. Alternatively, the hall effect sensor 17 may be positioned in both housings 12*a* and 12*b*. The flexible coated wire 16 may also include a single magnet 20 if a single hall effect sensor 17 is used in the headphones 10. In this case, the single magnet 20 is positioned in-between the housings 12*a* and 12*b*.

In general, the antenna 54 (or alternatively a transceiver) may receive audio data from the mobile device (not shown) via Bluetooth or other suitable protocol. The audio controller 52 may include a digital signal processor (not shown) for processing the received audio data and for transmitting the same to the loudspeakers 14*a*, 14*b* for playback. A charge protector circuit 70 may also be optionally be provided to protect the microprocessor 50 and the audio controller 52 from an over-voltage condition during recharging. As such, the charge protector circuit 70 may be positioned upstream of the microprocessor 50 and the audio controller 52 and receives voltage from an external power source 80. The first power supply 60 receives voltage from the external power source 80. The first power supply 60 provides power to the audio controller 52 and to the second power supply 62. The second power supply 62 generally provides a lower voltage than the first power supply 60 and powers the microprocessor 50 and the hall effect sensor 17*a* (or 17*b*). The switches 64 enable the user to select volume control, stop, play, etc. For example, the microprocessor 50 receives inputs from the switches 64 and transmits a control signal (e.g., CTRL) to the audio controller 52. The audio controller 52 responds to the desired operation as indicated via the switches 64 in response to the control signal from the microprocessor 50.

The hall effect sensor 17*a* (or 17*b*) is electrically coupled to the microprocessor 50. When the hall effect sensor 17 is generally configured to provide an output to the microprocessor 50 when the hall effect sensor 17 is positioned within the predetermined operating distance of the magnet 20. In this case, the hall effect sensor 17 detects the appropriate level of magnetic flux from the magnet 20. However, when the user moves the hall effect sensor 17 (i.e., the housing 12) away from the magnet 20 in order to perform a pause or stop function with respect to audio playback, the hall effect sensor 17 acts as a switch and is disconnected from the microprocessor 50. In this case, the microprocessor 50 detects the open circuit condition and transmits data indicative of a stop or pause command to the audio controller 52. In response, the audio controller 52 performs the stop or pause operation.

When the user moves the housing 12 within the predetermined operating distance of the magnet 20 such that the hall effect sensor 17 detects the appropriate level of magnetic flux, the hall effect sensor 17 provides a low-level output to indicate to the microprocessor 50 that the user intends to playback the audio data. The microprocessor 50 transmits data indicative of a play command to the audio controller 52 which then resumes or starts playing audio data via the loudspeakers 14. An audio storage device 68 may be optionally implemented to provide additional audio data (i.e., more so than the audio data provided by the portable memory 66). In this case, the headphones 10 may be an MP3 player.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A headphone system comprising:

a first housing;

a second housing;

a flexible coated wire coupled to the first housing and the second housing;

a first loudspeaker coupled to the first housing for transmitting an audio signal;

a second loudspeaker coupled to the second housing for transmitting the audio signal; and a magnet embedded within the flexible coated wire for electrical coupling with a sensor positioned within the first housing to control an operation of playback of the audio signal based on a distance of the magnet in relation to the first housing.

2. The headphone system of claim 1, wherein the sensor is configured to generate a first signal indicative of the magnet being positioned within a predetermined distance of the sensor.

3. The headphone system of claim 2, wherein the predetermined distance is between 2 to 20 mm.

4. The headphone system of claim 2 further comprising a microprocessor being configured to receive the first signal and to enable playback of the audio signal from the first loudspeaker and the second loudspeaker in response to the first signal.

5. The headphone system of claim 4, wherein the sensor is further configured to generate a second signal indicative of the magnet being positioned outside of the predetermined distance of the sensor.

6. The headphone system of claim 5, wherein the microprocessor is further configured to receive the second signal and to disable playback of the audio signal from the first loudspeaker and the second loudspeaker in response to the second signal.

7. The headphone system of claim 1, wherein the flexible coated wire defines an ear hook for placement over an ear of a user.

8. The headphone system of claim 7, wherein the first housing is positioned on one end of the ear hook and the magnet is positioned on another end of the ear hook to position the magnet adjacent to the sensor in the first housing.

9. The headphone system of claim 7, wherein the flexible coated wire includes a looped portion to separate the magnet from the first housing.

10. The headphone system of claim 1, wherein the sensor is a Hall effect sensor.

11. A headphone system comprising:

a first housing;

a second housing;

a flexible coated wire coupled to the first housing and the second housing;

a first loudspeaker coupled to the first housing for transmitting an audio signal;

a second loudspeaker coupled to the second housing for transmitting the audio signal;

a magnet for electrical coupling with a sensor positioned within the first housing to control playback of the audio signal; and a flexible coated wire including an ear hook having the first housing positioned on one end of the ear hook and the magnet positioned on another end of the ear hook to position the magnet adjacent to the sensor in the first housing.

12. The headphone system of claim 11, wherein the magnet is completely embedded within the flexible coated wire for electrical coupling with the sensor to control an operation of playback of the audio signal based on a distance of the magnet in relation to the first housing.

13. The headphone system of claim 12, wherein the sensor is configured to generate a first signal indicative of the magnet being positioned within a predetermined distance of the sensor.

14. The headphone system of claim 13, wherein the predetermined distance is between 2 to 20 mm.

15. The headphone system of claim 13 further comprising a microprocessor being configured to receive the first signal and to enable playback of the audio signal from the first loudspeaker and the second loudspeaker in response to the first signal.

16. The headphone system of claim 15, wherein the sensor is further configured to generate a second signal indicative of the magnet being positioned outside of the predetermined distance of the sensor.

17. The headphone system of claim 16, wherein the microprocessor is further configured to receive the second signal and to disable playback of the audio signal from the first loudspeaker and the second loudspeaker in response to the second signal.

18. The headphone system of claim 11, wherein the flexible coated wire includes a looped portion to separate the magnet from the first housing.

19. The headphone system of claim 11, wherein the sensor is a hall effect sensor.

20. A headphone assembly comprising:

a first housing;

a second housing;

a flexible coated wire coupled to the first housing and the second housing;

a first loudspeaker positioned within the first housing for transmitting an audio signal;

a second loudspeaker positioned within the second housing for transmitting the audio signal; and a magnet embedded within the flexible coated wire for electrical coupling with a sensor positioned within the first housing to control an operation of the headphone assembly based on a distance of the magnet in relation to the first housing.

* * * * *